US008528270B2

(12) United States Patent
Chich et al.

(10) Patent No.: US 8,528,270 B2
(45) Date of Patent: Sep. 10, 2013

(54) FASCIA VENT

(75) Inventors: Adem Chich, Kearney, NJ (US); Sudhir Railkar, Wayne, NJ (US); Walter Zarate, Prospect Park, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 551 days.

(21) Appl. No.: 12/500,108

(22) Filed: Jul. 9, 2009

(65) Prior Publication Data

US 2010/0043312 A1 Feb. 25, 2010

Related U.S. Application Data

(63) Continuation-in-part of application No. 12/194,068, filed on Aug. 19, 2008.

(51) Int. Cl.
*E04B 7/00* (2006.01)
*E04D 3/40* (2006.01)
*E04D 13/00* (2006.01)

(52) U.S. Cl.
USPC ..... 52/95; 52/302.3

(58) Field of Classification Search
USPC ..... 52/95, 302.1, 302.3, 741.1, 199, 52/503, 606, 607, 92.1, 203, 473, 303, 305, 52/361; 454/364, 365, 366
See application file for complete search history.

(56) References Cited

U.S. PATENT DOCUMENTS

| | | | | | |
|---|---|---|---|---|---|
| 345,688 | A * | 7/1886 | Hayes | 454/199 |
| 2,954,727 | A * | 10/1960 | Katt et al. | 454/260 |
| 3,683,785 | A * | 8/1972 | Grange | 454/250 |
| 4,286,420 | A * | 9/1981 | Pharmakidis | 52/404.1 |
| 4,622,789 | A * | 11/1986 | Quinnell | 52/95 |
| 5,540,015 | A * | 7/1996 | Anthony | 52/95 |
| 5,996,289 | A * | 12/1999 | Allaster | 52/95 |
| 7,877,962 | B2 * | 2/2011 | Teffenhart, Jr. | 52/844 |

* cited by examiner

*Primary Examiner* — Joshua J Michener
*Assistant Examiner* — Theodore Adamos
(74) *Attorney, Agent, or Firm* — Womble Carlyle Sandridge & Rice, LLP

(57) ABSTRACT

A fascia vent for a roof structure includes a fascia board for attachment along the lower ends of roof rafters that support a roof deck above an attic space. The fascia vent has an exposed outside face and an inside face at least partly exposed to the attic space. In one embodiment, a plurality of slots are formed along the inside face of the fascia board with a lower end of the slots communicating with ambience along the bottom edge of the fascia board and an upper end of the slots communicating with the attic space. In another embodiment, a plurality of spaced vent pockets are formed in the inside face and a slot is formed along the bottom edge of the fascia vent communicating with the vent pockets. In use, hot air vented from the attic is replaced by fresh air that flows through the fascia vent and into the attic space.

37 Claims, 5 Drawing Sheets

FASCIA VENT

REFERENCE TO RELATED APPLICATION

This is a continuation-in-part of co-pending U.S. patent application Ser. No. 12/194,068 entitled Fascia Vent, filed on 19 Aug. 2008.

TECHNICAL FIELD

This disclosure relates generally to attic ventilation and more specifically to fascia vents.

BACKGROUND

Modern attic ventilation systems usually include outlet vents high on a roof through which hot air escapes from the attic, coupled with inlet vents in the soffit or eve regions of the roof. The outlet vents might, for instance, comprise ridge vents that extend along and cover a slotted roof ridge while inlet vents might include a plurality of louvered vents covering openings cut in the soffit. As hot air escapes the attic through the outlet vents by means of convection, which may be aided by vent fans in some cases, it is replaced by cooler outside air that is drawn into the attic through the inlet vents.

Many styles and configurations of inlet vents for attic spaces have been designed and used in the past. These include independent louvered soffit vents, continuous strips of louvered soffit vent, ventilating material installed behind or atop fascia boards, and complicated louvered fascia vents. A need persists, however, for an inlet vent that is effective, easily installed by the common carpenter, virtually undetectable when installed, and possessing a net free ventilating area (NFA) that compliments that of a companion roof vent such as a ridge vent. It is to the provision of such an inlet vent that the present invention is primarily directed.

SUMMARY

Briefly described, a combination fascia board and vent, referred to as a fascia vent, comprises an elongated fascia board having a width appropriate to form the fascia of a gable roof overhang. In one embodiment, the fascia board is fabricated of extruded plastic composite material, which may be formed with a hollow interior having longitudinally extending ribs forming longitudinal channels on the interior of the strip. Other materials, such as, for instance, solid plastics, solid composites, blown and skinned plastics, and wood may be used. In any event, the fascia board is formed on its inside face, i.e. the face that is exposed to the attic when the fascia vent is installed, with a plurality of spaced slots arrayed along a bottom edge and each slot extends laterally only part way across the width of the fascia board. The fascia board is installed by being fastened to the lower ends of the roof rafters with the array of spaced slots facing inwardly and with their bottom ends exposed to ambience along the bottom edge of the fascia board. Soffit boards are installed beneath the overhang between the fascia boards and the outside wall of a dwelling in the traditional way.

The exposed bottom ends of the slots in conjunction with the lengths of the slots provide vent paths for outside air to enter the attic. The number and spacing of the slots is selected to provide appropriate ventilating capacity to support the effective replenishment of the attic with fresh outside air as hot air exits the attic through the outlet vents. Thus, circulation is established that helps reduce the temperature within the attic as well as helping to prevent formation of mold and mildew due to trapped stagnant moist air. The fascia vent of this embodiment is thus an effective inlet vent for a variety of roof constructions including any roof with a ridge or gable or power exhaust vents. Further, it requires no special talent or tools to install since it is applied by a carpenter in the same manner as traditional fascia boards. Since the installation of the fascia board and vent are accomplished in a single operation, significant time is saved as compared to installing soffit or eve vents separately and in addition to the installation of fascia boards.

In another application, the fascia vent offers the additional benefit of providing for the venting of intake air into a structure that does not have conventional soffits or overhangs. In such installations, the fascia vent is installed against the outside wall of the structure beneath the roof decking. The slots in the back side of the fascia vent provide air passages for the flow in inlet air into the attic above.

In an alternate embodiment, the fascia vent is formed from a length of plastic or a composite or other appropriate material with an plurality of side-by-side substantially rectangular vent pockets arrayed along its interior surface. A slot bounded by interior and exterior slot walls is formed along the bottom edge of the fascia vent and intercepts and communicates with the pockets. The exterior slot wall is shorter than the interior slot wall so that airflow into the slot is from the bottom front portion of the fascia vent rather than vertically upwardly into the slot. This provides better ventilation in situations where the bottom edge of the fascia might be covered such as when used in homes without overhanging eves. The vent pockets are separated by ribs and a wider rib is located every eight inches along the fascia vent. The wider ribs are aligned with the ends of roof rafters so that fasteners such as nails can be driven through the wider ribs and into the ends of the rafters to fasten the ridge vent to the soffit.

These and other objects, features, and advantages of the fascia vent disclosed herein will become more apparent upon review of the detailed description set forth below when taken in conjunction with the accompanying drawing figures, which are briefly described as follows.

DETAILED DESCRIPTION

Figure 1:
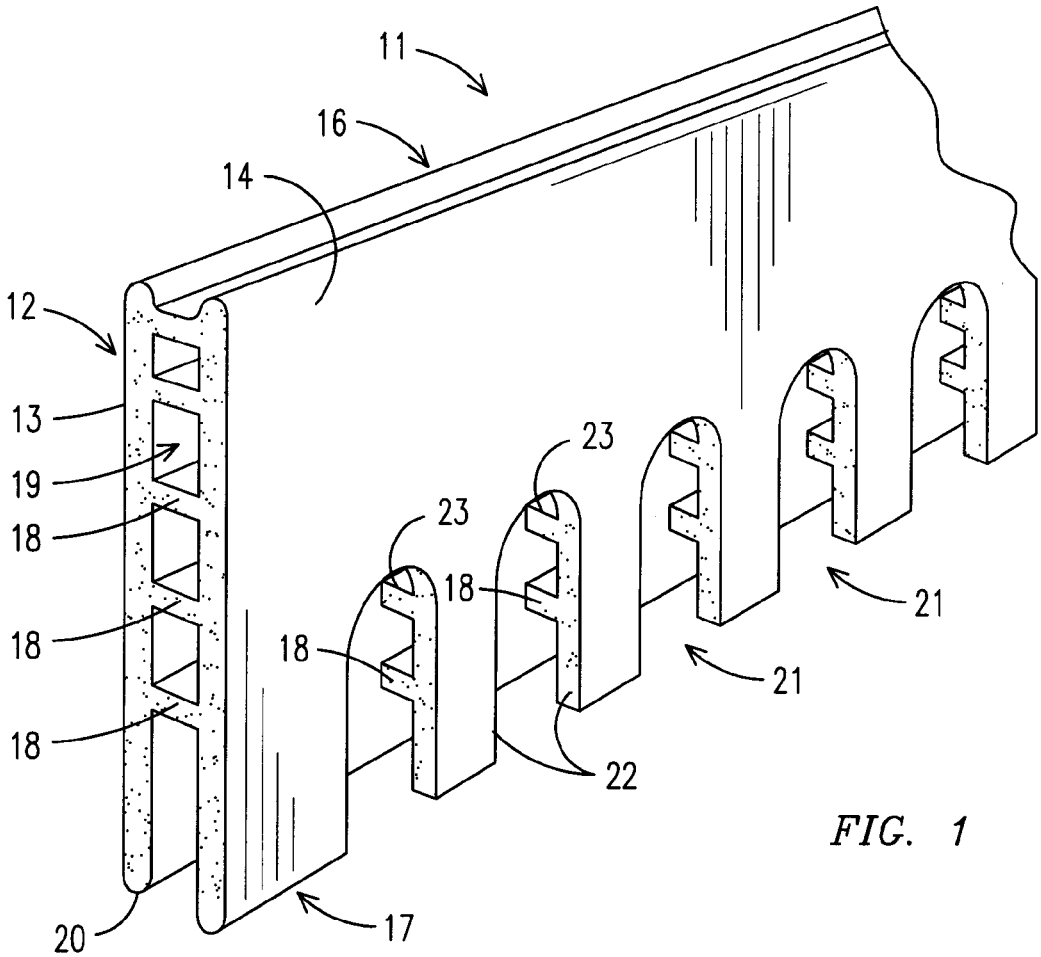
FIG. 1 is a perspective view of the inside face of a fascia vent that embodies principles of the present invention in one possible configuration.

Reference is now made in more detail to the drawing figures, wherein like reference numerals refer, where appropriate, to like parts in the several views. FIG. 1 illustrates a fascia vent that embodies principles of the invention in one possible configuration. The fascia vent 11 comprises an elongated fascia board 12 having an outside face 13 and an inside face 14. The outside face 13 and inside face 14 are spaced apart from each other and are connected together by a plurality of longitudinally extending internal ribs 18. The internal ribs 18, in turn, define a plurality of longitudinally extending interior channels 19 along the length of the fascia board 12. The fascia board 12 also has a top edge 16 and a bottom edge 17. At least the bottom edge 17 is shaped to form a drip edge 20 along the bottom of the outside face 13 to inhibit migration of water across the bottom edge 17 to the inside face of the fascia board 12.

In the embodiment of FIG. 1, the fascia board 12 is extruded from a plastic composite material which may comprise, for example, polypropylene with fillers that may include wood fiber, sawdust, rice hulls, or any of a number of fillers known to those of skill in the art. Alternatively, the fascia board may be formed from extruded PVC plastic that preferably is blown to provide a lighter weight yet strong structure. Other materials such as other plastics, aluminum or galvanized steel, or even traditional wood may be used to fabricate the fascia boards. In one embodiment, the fascia vent is fabricated from a fire retardant material, preferably a material that meets "class A" fire rating standards. Traditional thermoplastic and composite materials may be rendered fire retardant by including certain additives such as, for example, magnesium trioxide, antimony, alpha-alkyl-D-glucoside, Silica gel combined with potassium carbonate, and other additives generally known to thermoplastic fabricators. The fascia vent also may be fabricated by methods other than extrusion such as, for instance, injection molding, thermoforming, or any other appropriate manufacturing technique. However, an extruded material such as extruded polypropylene with fillers is preferred because it is strong, durable, resistant to deterioration, and permits extrusion of the fascia boards in significantly longer lengths, which reduces installation time and the number of end joints that result when the fascia vent is installed.

The fascia board 12 in FIG. 1 is formed with an array of slots 21 that are spaced apart along the inside face 14 of the fascia board. Each of the slots 21 extends transversely from the bottom edge 17 of the fascia board a predetermined distance to upper ends 23. In the embodiment illustrated in FIG. 1, the slots extend approximately half the width of the fascia board, although longer or shorter slots are possible. The depth of each slot 21 is less than the thickness of the fascia board, the slots extending inwardly in the illustrated embodiment to the inside surface of the outer face 13. In the embodiment of FIG. 1, the slots 21 cut through the support ribs 18 to form air passages that communicate between and among the plurality of slots 21. Of course, in an embodiment in which the fascia board is solid, such as in a fascia board made of blown PVC or other plastic, or wood, air passages between adjacent slots are not formed when the slots are made. Thus, air passages communicating between and among the slots is not a requirement. The slots 21 may be formed by any appropriate process such as, for example, by being machined with a router or other cutting tool, by being cut out, or by being molded directly into the fascia board as it is extruded or otherwise formed.

Figure 2:
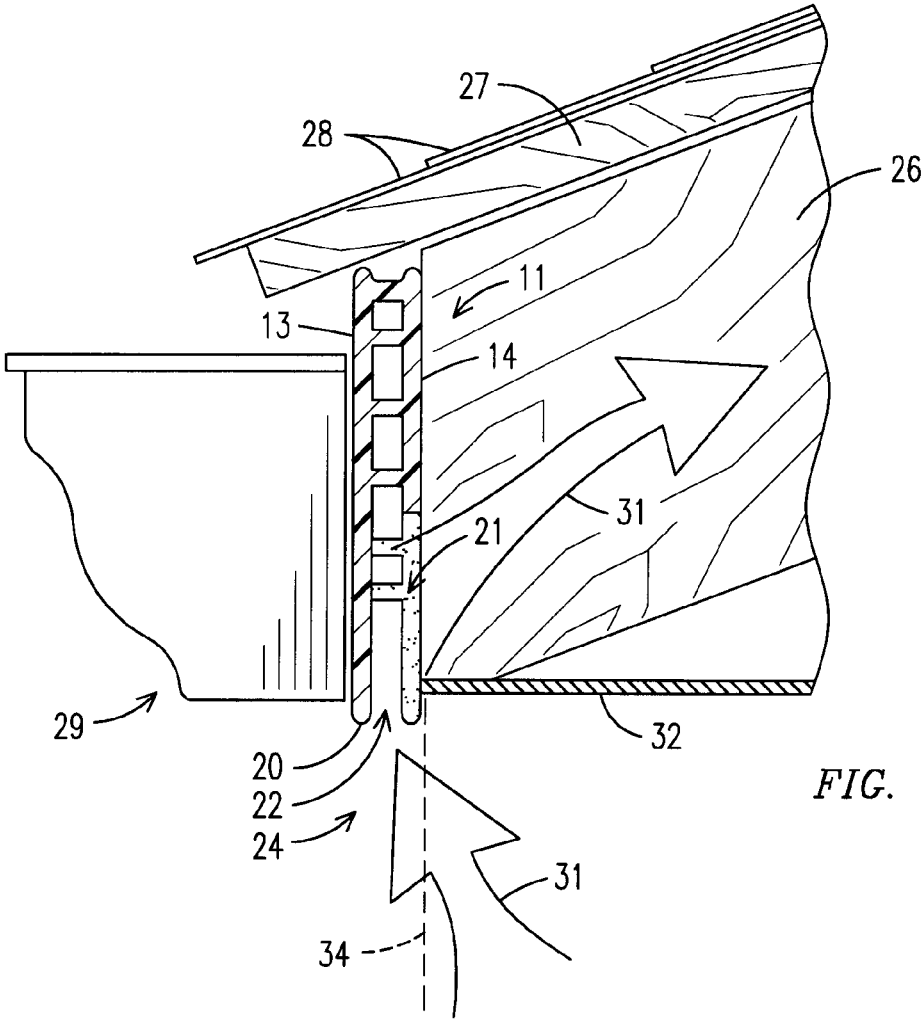
FIG. 2 is a cross sectional view showing the fascia vent of FIG. 1 installed and operational on a dwelling with a traditional soffit and overhang.

FIG. 2 shows the fascia vent 11 of FIG. 1 installed on a dwelling and is a cross section taken through one of the slots 21. More specifically, an eve 24 is formed from the projecting ends of roof rafters 26, roof decking 27 and shingles 28 secured atop the roof rafters, and a soffit board 32 enclosing the bottom of the resulting rafter bay. The fascia vent 11 is secured to the ends of roof rafters 26 with appropriate fasteners such as nails, screws, adhesives, hangers, or any other appropriate fasteners (not shown). The outside face 13 of the fascia vent is exposed and presents the appearance of a traditional fascia board secured to the dwelling. In this regard, the outside face 13 in composite or plastic embodiments of the fascia vent may be formed with impressions of wood grain to simulate more closely the appearance of a traditional wooden fascia board. Rain gutters 29 may be secured along the outside face 13 of the fascia vent 11 using fastening devices such as gutter spikes and brackets. The design of the preferred embodiment of the fascia vent with its extruded composite construction and internal support ribs provides rigidity and strength to allow for the penetration and support of gutter fasteners and rain gutters suspended thereon.

The slots 21 on the inside of the fascia board 12 are open to and communicate with ambience on their lower ends and extend upwardly above the soffit board 32 so that upper end portions of the slots are exposed to and communicate with the interior of the otherwise enclosed soffit bay. It will thus be seen that the slots together form a vent extending along the entire length of the fascia through which outside air is free to flow, as indicated by arrows 31, through the bottoms of the slots, into the soffit bay, and thus into the attic of the dwelling. In this way, the attic can be replenished with cool fresh outside air as hot attic air is expelled through ridge vents or other outlet vents higher on the roof.

While the fascia vent is illustrated in FIG. 2 installed along the overhang of a gable roof, it will be understood that it is equally useful for providing attic ventilation for dwellings having roofs without a traditional soffit or overhang. In such installations, the ends of the roof rafters are substantially flush with the outside wall of the dwelling, which is illustrated by phantom line 34 in FIG. 2, and the fascia vent is installed against the outside wall. The function of the fascia vent is substantially the same as described above, except that air flows directly into the attic space rather than first into an overhanging soffit bay.

Figure 3:
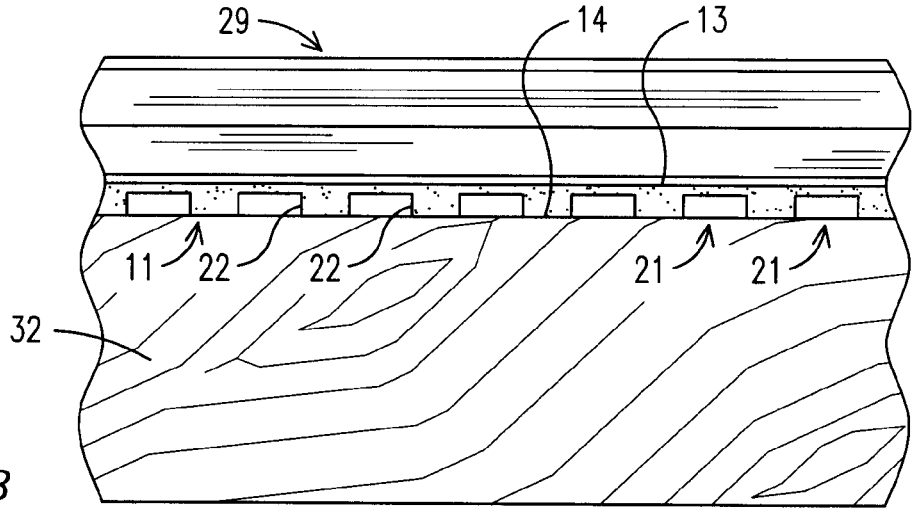
FIG. 3 is a view of the underside of the soffit and overhang of FIG. 2 illustrating how the slots in the fascia board form vents for inlet air to enter the attic space of the dwelling.

FIG. 3 is a view from the bottom of the soffit overhang of FIG. 1 and illustrates better the open lower ends 22 of the ventilating slots 21. It can be seen here that the ventilation slots are subtle and aesthetically pleasing and, in fact, are virtually undetectable when viewing a dwelling from a distance. This is an improvement over traditional soffit vents, which can be highly visible along the underside of the soffit and are considered by some to be unsightly. While not illustrated in the figures, the slots preferably are filled or covered with a material designed to prevent insects and moisture from migrating into the attic through the slots. For example, the lower ends 22 of the slots may be covered with an overlapping screen material or a vented strip with openings sized to allow ventilation while preventing insect migration. Alternatively, the slots may be filled with an open weave mesh material such as that used in the fabrication of Cobra® brand rolled ridge vent available from GAF Materials Corporation and described in U.S. Pat. No. 5,167,579. Such material permits air flow while inhibiting migration of insects and moisture through the vent slots.

The size and spacing of the vent slots 21 are predetermined to present a total net free ventilating area (NFA) at the soffit areas of a dwelling that compliments that of typical ridge or roof vent products. In this regard, a slot configuration that presents a total NFA of between 6 to 18 square inches for each foot of roof is preferred. In one particular example, a fascia vent according to the invention is provided with six vent slots per linear foot of fascia board. The width of each vent slot is 1 inch, the length of each slot to the semicircular top portion is 2 inches, the radius of the semicircle at the top of each slot is 0.5 inch, and the depth of each slot is 0.5 inch. With this configuration, the final installed NFA presented toward the attic space is about 11.3 square inches per linear foot of fascia vent where a 0.5 inch thick attic board is used for the soffit and about 9.9 square inches per linear foot of fascia vent where a 0.75 inch thick attic board is used. When the fascia on both sides of a roof are considered, these numbers are doubled to about 22.6 and 19.8 square inches for each foot of roof. Also for this example, the NFA per linear foot of fascia vent of the air inlet to the vent (i.e. the exposed bottom ends of the slots) is about 6.1 square inches per foot for a single fascia board and thus about 12.2 total square inches for each foot of roof. It thus will be seen that, for this example, the effective NFA for each foot of roof is about 12.2 square inches, which is within the preferred range and compliments well the NFA of typical ridge and roof vent products.

Figure 4:
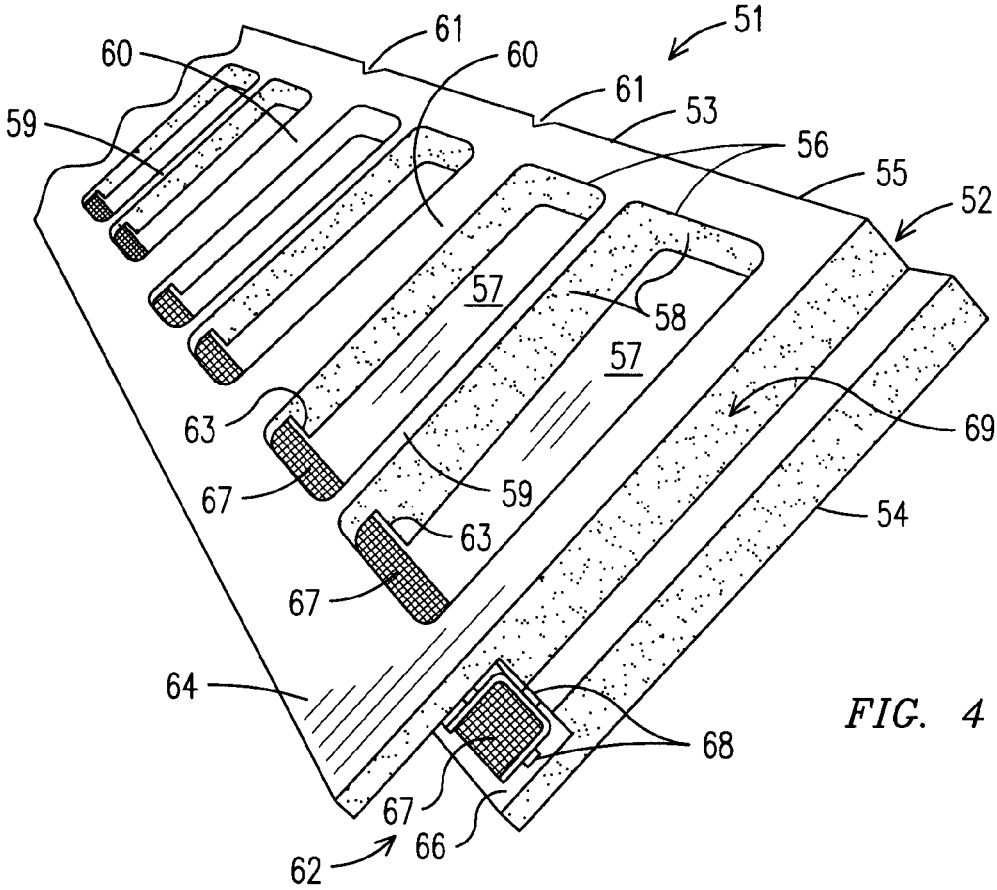
FIG. 4 is a perspective view of an alternate embodiment of the fascia vent illustrating the interior surface and bottom slot configurations.

FIGS. 4 through 9 illustrate an alternate embodiment of the fascia vent of this disclosure. FIG. 4 is a perspective view of a section of a fascia vent of this embodiment showing the inside face and an end thereof. The fascia vent 51 of this embodiment comprises an elongated fascia board 52 having an inside face 53, an outside face 54 and a top edge 55. The fascia board 52 can be made of any appropriate material such as, for instance, wood, wood composite, plastic, plastic composite or any other appropriate material, but preferably is formed of Polyvinylchloride (PVC) having a less dense foamed core and a more dense outer skin. An array of vent pockets 56 are formed in the inside face 53 of the fascia board. Each vent pocket 56 is a generally rectangular depression formed in the vent board and is bounded by a back wall 57 and upper and lateral side walls 58. The corners of the vent pockets are rounded in this illustration; however, this is not a requirement of the invention.

The vent pockets 56 are separated from each other along the length of the fascia board 52 by a set of relatively narrow ribs 59 and a set of relatively wide ribs 60. The wide ribs 60 preferably are located at eight inch intervals along the length of the fascia board and have a width that corresponds to the width of a typical roof rafter, which may, for example, be about 1.5 inches. In this way, a wide rib 60 can be aligned with the end of a corresponding roof rafter regardless of whether the roof rafters are spaced 16 inches on center or 24 inches on center. Alignment slots 61 are formed in the top edge 55 of the fascia board and these slots align with the wide ribs 60 to aid an installer in aligning the wide ribs with the ends of roof rafters during installation, as discussed in more detail below.

Figure 8:
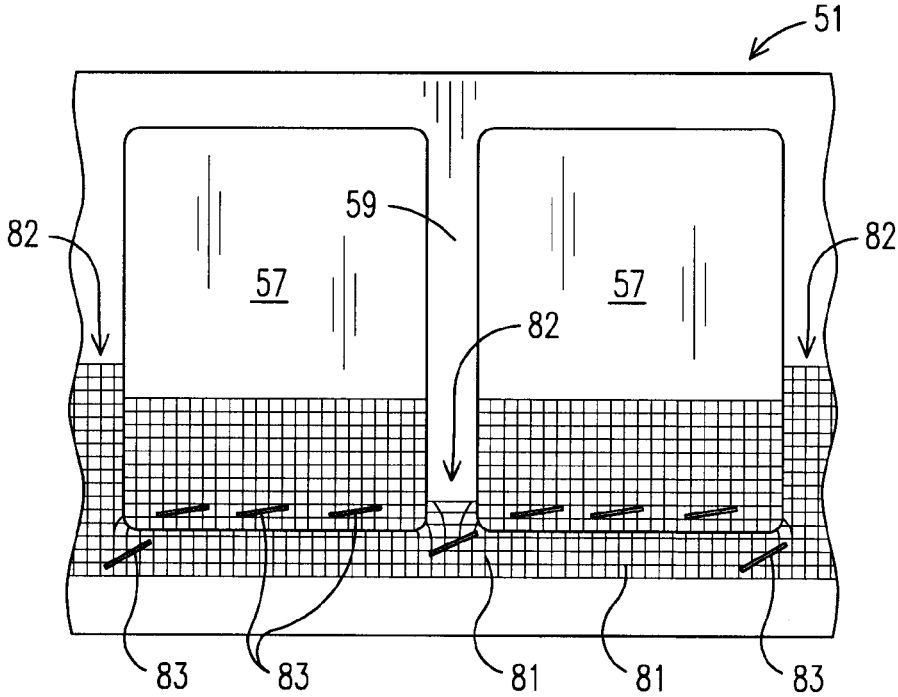
FIG. 8 is a plan view of a section of the interior face of the fascia vent of FIG. 4 illustrating an alternative configuration of installation of the mesh screen.

An elongated slot 62 is formed in and extends along the bottom edge portion of the fascia board. The slot 62 extends upwardly into the fascia board a sufficient distance so that the slot 62 intersects the vent pockets 56, indicated at 63, thereby establishing a flow path between the slot 62 and all of the vent pockets 56. The slot 62 is bounded on the inside of the fascia board by a relatively long interior leg 64 and on the outside of the fascia board by a relatively short exterior leg 66. As detailed below, this allows air to enter from the bottom front of the fascia vent 51 rather than strictly from the bottom edge, which, in turn, provides certain advantages, particularly when installing the fascia vent on homes without an overhanging eve. A generally U-shaped mesh screen 67 is installed within and extends along the slot 62 to prevent ingress of insects into the vent pockets and, in turn, into an attic through the fascia vent 51. The mesh screen 67 can be fixed within the slot 62 in any appropriate manner, such as by adhesive 68 or, alternatively, by mechanical fasteners such as staples if desired. Regardless, the mesh screen is interposed in all vent passages between the slot 62 and the vent pockets 56. Alternate barriers such as, for instance, the aforementioned Cobra® mesh material also may be used within the scope of the invention. As an alternative to mesh screen within the elongated slot, FIG. 8 illustrates that the mesh screen 81 can be applied to the interior face of the fascia vent, slit at the ribs (indicated at 82) to form flaps of screen, and the flaps pressed and extending into the vent pockets and secured with, for example, staples 83. Of course, the mesh screen can be secured by other means such as, for instance, with adhesives, hot melt, or sonic welding. With this embodiment, the mesh screen also is interposed in the vent passages between the elongated slot and the vent pockets to prevent ingress of insects and the like.

The ends of the fascia vent 51 are formed with mating features, such as a dado or half-lap 69, that allow ends of like fascia vents to be joined securely to produce a water-tight joint. While mating half-lap joints are illustrated, it will be understood that other mating features such as, for example, tongue-and-groove joint features might be substituted with equivalent results. While only a short section of the fascia vent 51 is illustrated in FIG. 4, it is preferred that the fascia vent be provided in long lengths such as, for example, 16 or 20 feet so that a minimum number of joints are necessary along the length of an eve to which the fascia vent is applied.

Figure 5:
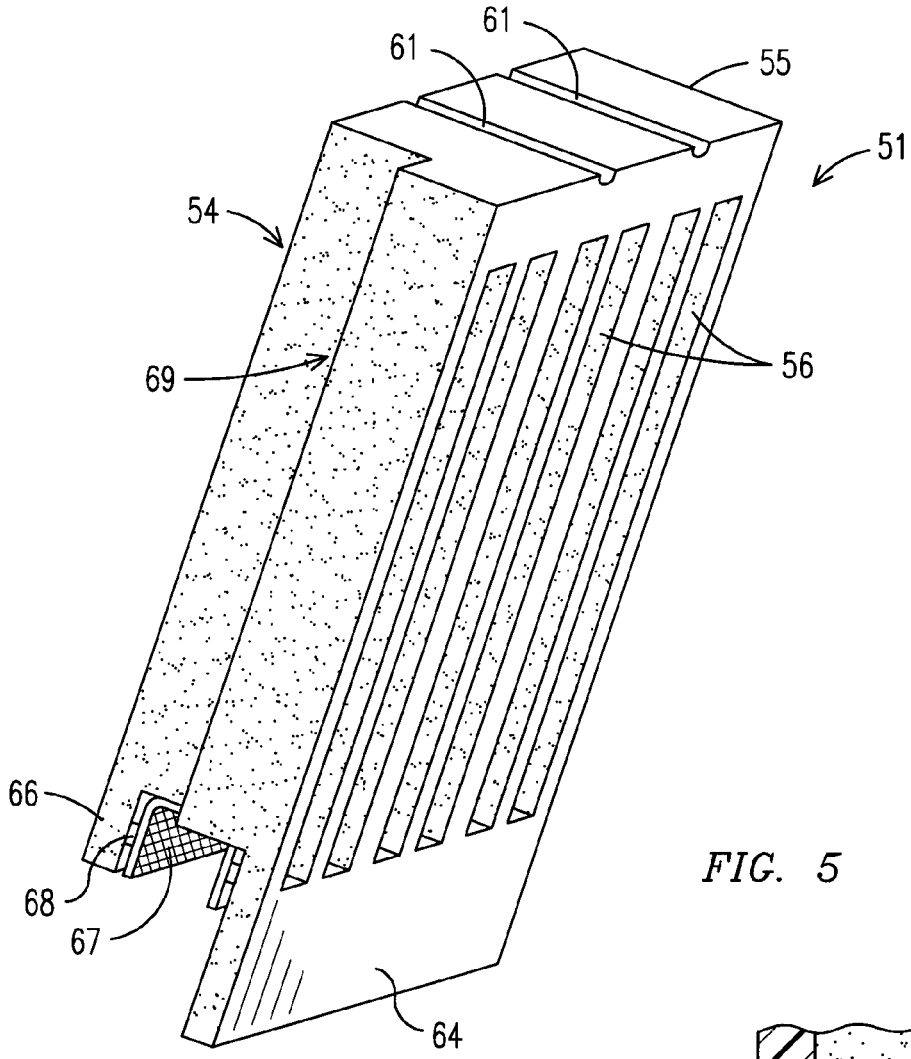
FIG. 5 is a perspective view of the fascia vent of FIG. 4 from another angle showing the alignment slots formed along the top edge of the fascia vent.

FIG. 5 is a view of the fascia vent 51 from another perspective showing more clearly the alignment grooves 61 formed in the top edge 55 of the vent. The alignment grooves are centered with respect to each of the wide ribs separating vent pockets 56. Thus, when installing the fascia vent along an eve, the installer can identify the locations of the wide ribs 60 from the outside face 54 of the vent so that the wide ribs can be aligned easily with the ends of roof rafters to which the fascia vent is to be attached with nails or screws. Also visible in FIG. 5 is the long interior leg 64, the short exterior leg 66, and the mesh screen 67 installed within and along the slot.

Figure 6:
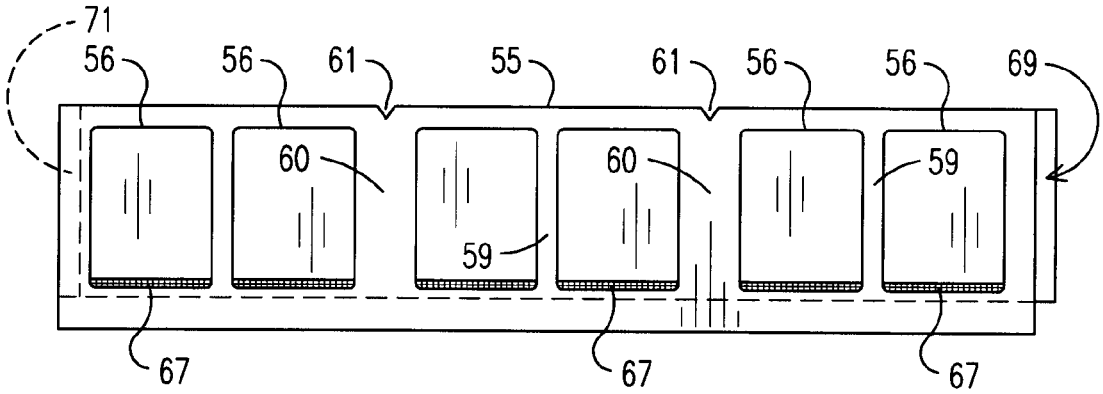
FIG. 6 is a plan view of the interior surface of the fascia vent of FIG. 4 illustrating its wider ribs located at eight inch intervals.

FIG. 6 is a plan view of the fascia vent 51 showing the interior surface thereof. While only a short length of fascia vent is shown, it will be understood that the actual fascia vent may be many feet long, as mentioned above. As can be more clearly seen in FIG. 6, the vent pockets 56 are separated by narrow ribs 59 and wide ribs 60, with the wide ribs being spaced apart 8 inches on center. The alignment grooves 61 formed in the top edge of the fascia vent are clearly visible in FIG. 6 to indicate the center of each of the wide ribs 60. The inwardly facing half-lap 69 is seen on the right end of the fascia vent in FIG. 6 and a corresponding outwardly facing half-lap 71 is shown on the left end of the fascia vent. The two oppositely facing half-laps are sized and configured to mate with each other to form a clean waterproof joint between two lengths of fascia vent joined together at their ends. In addition, the ends of the fascia vent are located at the position where a wide rib would fall, so that the joint falls at the location of a roof rafter. In this way, fasteners such as nails may be driven through the joint and into a rafter to fix the joint securely.

Figure 7:
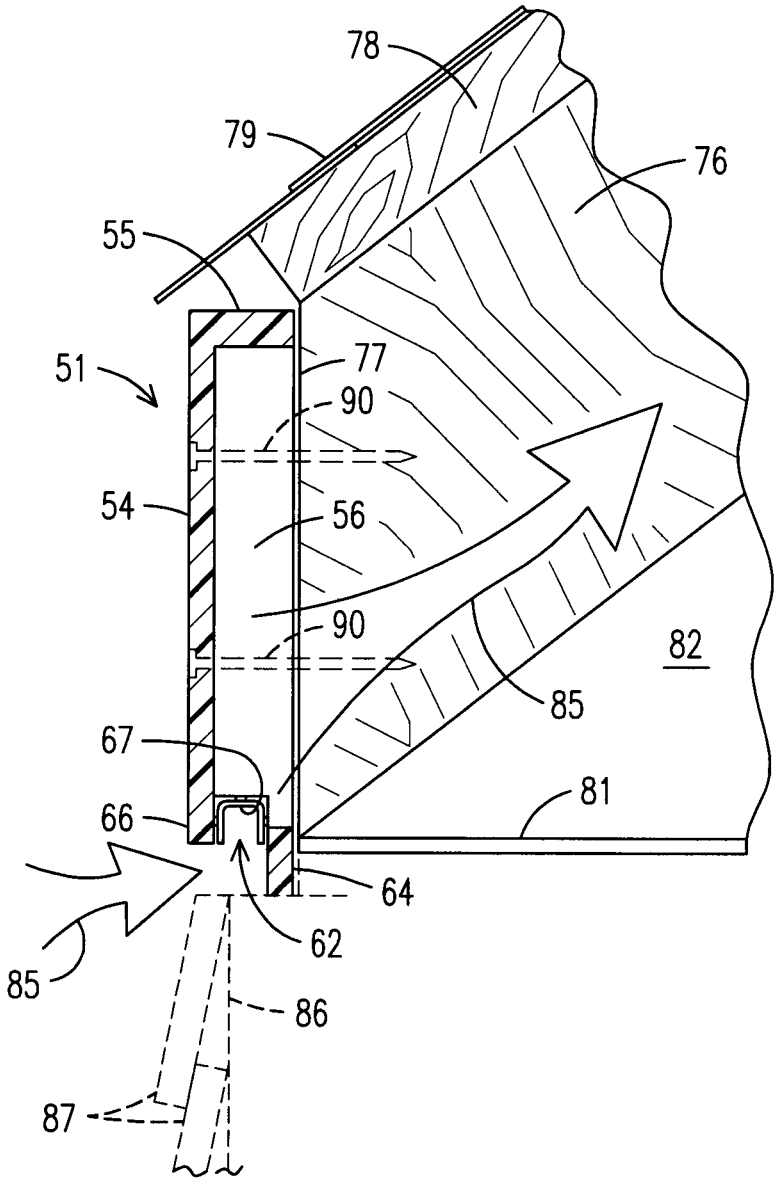
FIG. 7 is a cross sectional view of a portion of the eve of a home with the fascia vent of FIG. 4 installed. The cross section is taken through one of the vent pockets in the interior surface of the fascia vent.

FIG. 7 is a cross-sectional view showing the fascia vent of this embodiment installed along the edge of an eve as a fascia board. The cross-section is taken through the fascia vent between two roof rafters. A roof includes a plurality of roof rafters 76 (only one of which is visible in FIG. 7), to the tops of which a roof deck 78 and shingles 79 are attached. The angled ends 77 of the roof rafters 76 typically overhang an outside wall of a dwelling and are aligned with each other to form an overhanging eve. The bottom of the eve is covered by a soffit board 81 that, with the roof deck, bounds the overhang to define a soffit bay that is part of and in communication with the attic space of the dwelling.

The fascia vent 51 is installed along the aligned ends of the roof rafters 76 to form the fascia of the roof structure. More specifically, the fascia vent is oriented along the ends of the roof rafters by an installer and its position adjusted so that at least one of the alignment slots, which are visible to the installer from the outside face of the vent, is positioned at the center of a corresponding roof rafter. This insures, in turn, that the end of each roof rafter aligns with one of the wide ribs on the inside face of the fascia vent. The fascia vent can then be attached to the ends of the roof rafters 76 by driving nails 90 through the wide ribs of the fascia vent and into the ends of the roof rafters as shown, thereby closing the soffit bay. Of course, other fasteners such as screws and/or adhesives might also be used.

With the fascia vent 51 thus installed, it will be seen that a ventilation path is established between the outside ambient atmosphere and the attic space of the dwelling. More specifically, as hot attic air flows by convection out of the attic through roof vents such as, for instance, ridge vents, this draws cool ambient air (illustrated by arrows 85 in FIG. 7) through the slot 62 along the bottom edge of the fascia vent, into the vent pockets 56, and into the attic. Further, the short leg 66 bounding the outside of the slot 62 and the long leg 64 bounding the inside of the slot 62 defines an inlet to the slot and thus to the attic that is oriented toward the front of the fascia vent rather than being oriented strictly vertically from the bottom. This feature can be important, particularly when the fascia vent of this disclosure is installed on a dwelling without an overhanging eve and flush with an outside façade of the dwelling. This type of dwelling is illustrated in phantom lines in FIG. 7, where the outside wall 86 of the dwelling is substantially aligned with the elongated slot of the fascia vent and typically is covered with a façade, such as, for instance, clapboards 87, which may be substantially flush with the outside face of the fascia vent. As can be seen, the fascia vent still provides ventilation since the inlet to the elongated slot and the vent pockets faces toward the outside rather than downwardly. With the embodiment of FIG. 1, the façade is likely to cover partially or completely the vent openings along the bottom edge of the fascia vent, thereby limiting or blocking airflow through the fascia vent. However, with the alternate embodiment of FIGS. 4 through 9, the inlet of the elongated slot faces outward so that the façade does not interfere with airflow through the fascia vent and the fascia vent can be mounted flush with the outside of the dwelling.

While the dimensions of the various features of the embodiment of FIGS. 4 through 9 can be selected to accommodate particular design requirements, the following dimensions have been found to provide a net free ventilation area (NFA) at the eves of a structure that compliments that of corresponding attic vents such as ridge vents, and thus represents the best mode of carrying out the invention. With reference to FIGS. 4 and 7, the preferred thickness of the fascia board 52 from its interior surface 53 to its exterior surface 54 is approximately 1.25 inches and the legs that bound the slot 62 along the bottom edge of the fascia board preferably are approximately 0.25 inch thick. This means that the slot itself is 0.75 inch wide. The interior leg 64 preferably is approximately 1.25 inches long while the exterior leg 66 preferably is about 0.5 inches long, meaning that the distance between the bottom of the exterior leg 66 and the bottom of the interior leg 64 is approximately 0.75 inch, the same width as the slot itself. This forms an outside facing inlet with the same NFA as the slot 62. The fascia board 52 itself preferably is approximately 6 inches wide with the vent pockets 56 being approximately 4.375 inches tall. The depth of the vent pockets 56 formed in the interior face 53 of the fascia board preferably is approximately 1 inch, such that the back walls 57 of the vent pockets are coextensive with the inside surface of the exterior leg 66 bounding the slot. With these dimensions, it can be established that the NFA of the fascia vent of this embodiment is about 9 square inches per foot of fascia vent. When two opposite eves are provided with fascia vents, the total NFA along the eves of the roof is then 18 inches per foot of roofline, which compliments very well the NFA of a typical ridge vent or other roof vent. Of course, any NFA between about 6 and about 12 square inches per linear foot of fascia vent may be acceptable.

Figure 9:
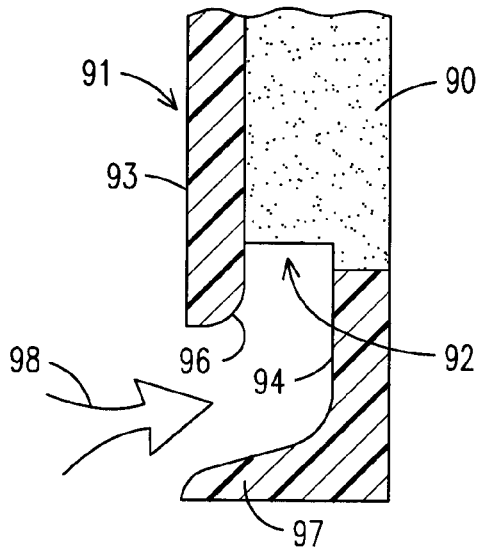
FIG. 9 is a cross section of a portion of a fascia vent showing an alternate configuration of the inlet to the elongated slot with aerodynamic properties.

FIG. 9 illustrates an alternate embodiment of the fascia vent of claims 4 through 9 that includes an aerodynamic inlet to the elongated slot that presents less resistance to incoming air flow and thus enhances the ventilation properties of the fascia vent. FIG. 9 is a cross-section of the lower portion of the fascia vent taken through one of the vent pockets 90. In this embodiment, the outside leg 93 is formed with a smoothly curved interior edge 96 and the inside leg 94 with a smoothly curved outwardly extending lip 97. The curved interior edge 96 and the curved lip 97 together bound and define an aerodynamic inlet to the elongated slot 92 that faces outward and that admits ventilating air 98 to the elongated slot 92 and ultimately to the attic with less frictional resistance.

The invention has been described herein in the context of preferred embodiments and methodologies considered by the inventors to represent the best modes of carrying out the invention. It will be understood, however, that various modifications to the illustrated embodiments, both subtle and gross, may be made by skilled artisans without departing from the spirit and scope of the invention. For instance, while preferred materials for the fabrication of the fascia vent have been presented, any material or fabrication process suitable for making the fascia vent is intended to be included herein. Further, the particular configurations or shapes of the slots, their sizes, and their lateral extent all may be modified to meet a particular commercial application or need. The slots need not extend completely through the inside face of the fascia board along their entire lengths, but may, for instance, be enclosed at their bottoms and open within the soffit bay area of a roof. In the alternate embodiment of FIGS. 4 through 9, the vent pockets have been illustrated as rectangular in shape; however, they may take on other shapes such as, for instance, triangular, circular, oval, or otherwise so long as sufficient air flow is established into an attic. Mechanisms other than the illustrated alignment grooves may be employed to assist an installer to align the fascia properly for fastening to the ends of roof rafters. For example, small indentations, small bumps, or a marking on the exterior face of the vent might mark the locations of the wide ribs equally well. Further, while the preferred configuration of this embodiment includes a plurality of spaced apart vent pockets on the inside face of the fascia board, it is within the scope of the invention that a single long vent pocket be provided. Thus, the term "vent pocket" as used herein and in the claims should be construed broadly to include a plurality of spaced pockets, a single long vent pocket, or any appropriate feature that communicates with the attic space when the fascia vent is installed. Also, while the slot is formed along the bottom edge of the fascia board in the preferred embodiment, it might just as well be formed at another location on the fascia board, such as, for instance, along the outside face, so long as the slot communicates with the ambient atmosphere and one or more vent pockets. The scope of the present invention is not limited by these and other details but rather is defined and circumscribed only by the language of the following claims.

What is claimed is:

1. A fascia vent comprising:

an elongated fascia board having a thickness, an outside face, an inside face, a top edge, and a bottom edge, the fascia board being sized for installation along a lower edge of a roof with at least part of its inside face exposed to an attic beneath the roof;

a plurality of vent pockets formed through the inside face of the fascia board, each of the plurality of vent pockets being substantially defined by a back wall, an upper sidewall, and lateral sidewalls of the vent pocket between the outside face and the inside face of the fascia board, with the fascia board between the upper sidewall and the top edge being a substantially solid material between the outside face and the inside face; and an elongated slot formed in and extending along a lower portion of the fascia board and being exposed to ambient atmosphere, the slot extending into the material of the fascia board a distance sufficient to intersect the plurality of vent pockets thereby forming a flow path between the ambient atmosphere and the plurality of vent pockets.

2. The fascia vent of claim 1 and wherein the plurality of vent pockets comprise a plurality of spaced vent pockets.

3. The fascia vent of claim 2 and wherein the vent pockets are substantially rectangular.

4. The fascia vent of claim 2 and wherein the vent pockets are spaced apart by ribs.

5. The fascia vent of claim 4 and wherein at least some of the ribs are wider than other ones of the ribs.

6. The fascia vent of claim 5 and wherein the wider ribs are spaced so that a wider rib aligns with a corresponding roof rafter when the fascia vent is installed.

7. The fascia vent of claim 6 and wherein the wider ribs are spaced approximately eight inches apart on center.

8. The fascia vent of claim 6 and further comprising indicia indicating the locations of the wider ribs to an installer during installation of the fascia vent.

9. The fascia vent of claim 8 and wherein the indicia comprises grooves formed in the top edge of the fascia board at locations of the wider ribs, the grooves being visible from the outside face of the fascia vent.

10. The fascia vent of claim 1 and wherein the elongated slot is formed along the bottom edge of the fascia board.

11. The fascia vent of claim 10 and wherein the elongated slot is bounded by an exterior leg and an interior leg.

12. The fascia vent of claim 11 and wherein the interior leg is longer than the exterior leg.

13. The fascia vent of claim 12 and wherein the elongated slot has a width and wherein the difference between the length of the interior leg and the exterior leg is substantially the same as the width of the elongated slot.

14. The fascia vent of claim 1 and further comprising a mesh screen interposed in the flow path to preventingress of insects and debris.

15. The fascia vent of claim 14 and wherein the mesh screen is positioned within the elongated slot.

16. The fascia vent of claim 1 and wherein the fascia board has ends and wherein the ends are formed with mating features for joining a fascia vent to a substantially similar fascia vent at their ends.

17. The fascia vent of claim 16 and wherein the mating features are cooperating half-laps.

18. The fascia vent of claim 1 and further comprising a mesh screen on the inside face of the fascia board, at least portions of the mesh screen extending into the plurality of vent pockets to preventingress of insects into the vent pockets.

19. The fascia vent of claim 1 and wherein the elongated slot is formed along the bottom edge of the fascia board and is bounded by an outside leg and an inside leg and wherein at least one of the legs is shaped to form an aerodynamic inlet to the elongated slot.

20. The fascia vent of claim 19 and wherein the outside leg is shorter than the inside leg and the inside leg includes an outwardly projecting curved lip that at least partially bounds the aerodynamic inlet.

21. The fascia vent of claim 20 and wherein the outside leg is formed with a curved inner edge that at least partially bounds the aerodynamic inlet.

22. A fascia vent comprising:

an elongated fascia board having a thickness, an outside face, an inside face, a top edge, a bottom edge, and ends, the fascia board being sized for installation along a lower edge of a roof with at least part of its inside face exposed to an attic beneath the roof;

a plurality of spaced apart vent pockets disposed along the inside face of the fascia board, each of the plurality of vent pockets extending through the inside face and into the fascia board a distance less than the thickness of the fascia board and being substantially defined by a back wall within the fascia board, an upper side wall extending from the back wall to the inside face of the fascia board, and spaced apart laterally extending ribs projecting from the back wall to the inside face of the fascia board; and a slot extending along the bottom edge of the fascia board and being exposed to ambient atmosphere when the fascia vent is installed along a lower edge of a roof;

the slot extending into the fascia board a distance sufficient to intersect at least some of the plurality of vent pockets thereby forming a flow path between the slot and the vent pockets intersected by the slot.

23. The fascia vent of claim 22 further comprising a material disposed in the flow path and being configured to inhibit movement of insects from the slot to the vent pockets intersected by the slot.

24. The fascia vent of claim 22 wherein the distance between the spaced apart ribs is selected so that one of the spaced apart ribs can be aligned with each of a plurality of roof rafters when the fascia vent is installed along a lower edge of a roof.

25. The fascia vent of claim 24 wherein ribs that can be aligned with roof rafters are wider than ribs that do not align with roof rafters when the fascia vent is installed along a lower edge of a roof.

26. The fascia vent of claim 25 further comprising indicia on the fascia board visible from the outside face thereof for indicating the locations of the wider ribs to an installer as an aid to aligning the wider ribs with corresponding roof rafters when installing the fascia vent along the lower edge of a roof.

27. The fascia vent of claim 22 further comprising features at the ends of the fascia board to facilitate the joining together of two substantially similar fascia boards in an end-to-end relationship along a lower edge of a roof.

28. The fascia vent of claim 27 wherein the features are formed in the material of the fascia board.

29. The fascia vent of claim 28 wherein the features comprise cooperating half-laps.

30. A roof structure on a dwelling comprising:

a plurality of roof rafters having ends;

a roof deck supported atop the roof rafters overlying an attic space;

a fascia vent secured to the ends of the rafters and extending along an edge of the roof structure;

the fascia vent formed of a substantially solid material and having a thickness, an exterior surface, an interior surface, and a bottom edge, the interior surface being formed with a plurality of vent pockets extending into the material of the fascia vent, each of the plurality of vent pockets being substantially defined by a back wall, an upper sidewall, and lateral sidewalls of the vent pocket within the fascia vent, the upper sidewall and lateral sidewalls comprising the substantially solid material between the exterior surface and the interior surface;

a slot formed along a lower portion of the fascia vent, the slot being exposed to ambient air and extending into the material of the fascia vent a distance sufficient to intersect with at least some of the plurality of vent pockets;

the slot and the vent pockets intersected thereby forming a flow path for ambient air to enter the attic space beneath the roof deck.

31. The roof structure of claim 30 and wherein the slot is formed along the bottom edge of the fascia vent and is bounded by an exterior leg adjacent the exterior surface of the fascia vent and an interior leg adjacent the interior surface of the fascia vent.

32. The roof structure of claim 31 and wherein the exterior leg is shorter than the interior leg.

33. The roof structure of claim 32 and wherein the slot has a width and wherein the difference between the length of the interior leg and the exterior leg is substantially the same as the width of the slot.

34. The roof structure of claim 30 and wherein the fascia vent is fabricated from a material selected from the group consisting of plastic, plastic composite, plastic with a filler, wood, wood composite, polyvinylchloride, foamed polyvinylchloride, and polyvinylchloride with a foamed core and a non-foamed skin.

35. The roof structure of claim 30 and wherein the slot and vent pockets are sized to provide a predetermined net free ventilating area per foot of fascia vent.

36. The roof structure of claim 35 and wherein the net free ventilating area is between about 6 square inches per linear foot of fascia vent and about 12 square inches per linear foot of fascia vent.

37. The roof structure of claim 36 and wherein the net free ventilation area is about 9 square inches per linear foot of fascia vent.

* * * * *